US006447664B1

(12) United States Patent
Taskovics et al.

(10) Patent No.: US 6,447,664 B1
(45) Date of Patent: Sep. 10, 2002

(54) METHODS FOR COATING METALLIC ARTICLES

(75) Inventors: Steven Taskovics, Framingham; Paul Dicarlo, Middleboro; Bruce W. Flight, Melrose, all of MA (US); V. Chandru Chandrasekaran, Mercer Island; Daniel Vancamp, Redmond, both of WA (US)

(73) Assignee: Scimed Life Systems, Inc., Maple Grove, MN (US)

( * ) Notice: Subject to any disclaimer, the term of this patent is extended or adjusted under 35 U.S.C. 154(b) by 0 days.

(21) Appl. No.: 09/227,407

(22) Filed: Jan. 8, 1999

(51) Int. Cl.[7] ..... C25D 5/10; C25D 5/34

(52) U.S. Cl. ..... 205/170; 205/205; 205/219

(58) Field of Search ..... 427/2.1, 307, 327; 205/205, 219, 170; 623/900, 1.15; 606/151; 428/629, 472, 472.1, 660, 680, 672

(56) References Cited

U.S. PATENT DOCUMENTS

| | | | | | |
|---|---|---|---|---|---|
| 3,748,712 | A | * | 7/1973 | Karawin | 29/119 |
| 4,416,739 | A | * | 11/1983 | Turner | 204/32 R |
| 4,938,550 | A | * | 7/1990 | Rothschild et al. | 204/29 |
| 4,938,850 | A | | 7/1990 | Rotschild et al. | 204/29 |
| 5,152,774 | A | | 10/1992 | Schroeder | 428/457 |
| 5,176,803 | A | * | 1/1993 | Barbuto et al. | 204/129.1 |
| 5,242,759 | A | * | 9/1993 | Hall | 428/610 |
| 5,344,425 | A | * | 9/1994 | Sawyer | 606/198 |
| 5,464,524 | A | * | 11/1995 | Ogiwara et al. | 205/170 |
| 5,591,320 | A | | 1/1997 | Rolander | 205/664 |
| 5,824,045 | A | * | 10/1998 | Alt | 623/1 |
| 5,897,567 | A | * | 4/1999 | Ressemann et al. | 606/159 |
| 5,919,126 | A | * | 7/1999 | Armini | 600/3 |

FOREIGN PATENT DOCUMENTS

| | | | |
|---|---|---|---|
| DE | 197 46 309 | | 4/1999 |
| JP | 4-276093 | * | 10/1992 |
| JP | 4-276093 A | * | 10/1992 |
| WO | WO9837579 | | 8/1998 |
| WO | WO0029035 | | 5/2000 |

OTHER PUBLICATIONS

Electroplating Engineering Handbook, pp. 299–300, c.1971 no month available.*

(List continued on next page.)

*Primary Examiner*—Edna Wong
(74) *Attorney, Agent, or Firm*—Todd P. Messal

(57) ABSTRACT

Methods for coating metallic articles. In an exemplary embodiment, the method comprises the steps of providing a metallic article having an external surface with an oxide thereon; removing at least part of the oxide from the external surface of the article; and placing a coating on the article. The invention also includes coated metallic articles, and an apparatus for coating metallic articles.

7 Claims, 1 Drawing Sheet

OTHER PUBLICATIONS

C.M. Wayman, "Some Applications of Shape–Memory Alloys", Journal of Metals, Jun. 1980, pp. 127–137.

Patent Abstracts of Japan, vol. 015, No. 263, Jul. 4, 1991 & JP 03 090555 A 9Showa Electric Wire & Cable Co Ltd), Apr. 16, 1991.

Database WPI, Section Ch, Week 198939, Derwent Publications Ltd., London, GB; Class A96 & JP 01 209069 A 9Tohoku Metal Ind Ltd), Aug. 22, 1989.

Green S M et al.: Effect of N/sup +/implantation on the shape–memory behaviour and corrosion resistance of a equiatomic NiTi alloy Journal of Materials Science Letters, May 1, 1993, UK, vol. 12, No. 9, pp. 618–619.

Database WPI, Section Ch, Week 198624, Derwent Publications Ltd., London, GB, Class M14, AN 1986–153471 & JP 61 087893 A (Mitsubishi Denki KK), May 6, 1986.

Patent Abstracts of Japan, vol. 010, No. 262, Sep. 6, 1986 & JP 61 087894 A (Kyowa Sangyo KK), May 6, 1986.

Patent Abstracts of Japan, vol. 016, No. 133, Apr. 6, 1992 & JP 03 295562 A (Daido Steel Co Ltd.), Dec. 26, 1991.

Patent Abstracts of Japan, vol. 014, No. 106, Feb. 27, 1990 & JP 01 310664 A (Furukawa Electric Co Ltd), Dec. 14, 1989.

Patent Abstracts of Japan, vol. 012, No. 410, Oct. 28, 1988 & JP 63 149396 A (Kobe Steel Ltd), Jun. 22, 1988.

O. Piotrowski et al.: *The Mechanism of Electropolishing of Titanium in Methanol–Sulfuric Acid Electrolytes,* J. Electrochem. Soc., vol. 145, No. 7, Jul. 1998, pp. 2362–2369.

* cited by examiner

METHODS FOR COATING METALLIC ARTICLES

FIELD OF THE INVENTION

The present invention relates to methods for coating metallic articles having oxides thereon.

BACKGROUND OF THE INVENTION

Nitinol, a class of nickel-titanium alloys, is well-known for its shape memory and pseudoelastic properties, making it amenable to a wide range of applications.

As a shape memory material, nitinol is able to undergo a reversible thermoelastic transformation between certain metallurgical phases. Generally, the thermoelastic shape memory effect allows the alloy to be shaped into a first configuration while in the relative high-temperature austenite phase, cooled below a transition temperature or temperature range at which the austenite transforms to the relative low-temperature martensite phase, deformed while in a martensitic state into a second configuration, and heated back to austenite such that the alloy transforms from the second configuration to the first configuration.

As a pseudoelastic material, nitinol is able to undergo an isothermal, reversible transformation from austenite to martensite upon the application of stress. The elasticity associated with the transformation to martensite and the resulting stress-induced martensite make pseudoelastic nitinol suitable for applications requiring recoverable, isothermal deformation. For example, conventional pseudoelastic nitinol is useful for applications requiring recoverable strains of up to 8% or more.

Since being discovered by William J. Buehler in 1958, the unique properties of nitinol have been applied to numerous applications. For example, as reported in C. M. Wayman, "Some Applications of Shape-Memory Alloys," *J. Metals* 129 (June 1980), incorporated herein by reference, nitinol has been used for applications such as fasteners, couplings, heat engines, and various dental and medical devices. Owing to the unique mechanical properties of nitinol and its biocompatibility, the number of uses for this material in the medical field has increased dramatically in recent years.

Implantable medical devices such as stents, blood filters, hemostatic clips, prostheses, and the like are often made from nitinol. Because of the elastic properties and shape memory characteristics of nitinol, these medical devices are capable of being compressed to a reduced configuration for insertion into the body and then expanded by self-expansion or mechanical expansion once positioned to a target location within the body. The position of these devices while moved within the body is often observed by fluoroscopic techniques, during which the device is visualized by x-radiation. As such, it is desired that the device be highly radiopaque. Nitinol, however, is not a highly radiopaque material.

One method of increasing the radiopacity of nitinol medical devices is to apply a coating of a highly radiopaque material to the external surface of the device by a process such as electroplating. However, effective electroplating is often difficult to achieve because of contaminants on the nitinol external surface, which result in potential problems such as poor adhesion of the plated coating. One such contaminant is oxide that readily forms on nitinol when exposed to an oxygen-containing atmosphere. Conventional methods may not be effective in removing such oxides and ensuring that such nitinol surfaces remain substantially oxide-free prior to the coating process. Moreover, conventional coating techniques often necessitate the use of hazardous chemicals. There thus exists a need for safe methods of removing oxide and other contaminants from nitinol-surfaces and keeping such surfaces clean and substantially oxide-free prior to the coating process.

SUMMARY OF THE INVENTION

In one aspect, the present invention relates to methods for coating metallic articles that have oxides thereon. In an exemplary embodiment, the method comprises the steps of providing a metallic article having an external surface with an oxide thereon; removing at least part of the oxide from the external surface of the article; and placing a coating on the article. In another aspect, the present invention relates to coated metallic articles. In yet another aspect, the invention relates to an apparatus for coating metallic articles.

One advantage of the present invention is that it provides methods for removing oxide from metallic surfaces so that the adhesion and integrity of subsequently applied coatings is enhanced.

Another advantage of the present invention is that it provides methods for removing oxide from metallic surfaces and applying radiopaque coatings without the use of hazardous chemicals.

Yet another advantage of the present invention is that it provides methods of removing oxides from metallic surfaces without creating a rough surface or causing the removal of excessive material, thus making it possible to treat delicate articles such as medical devices.

DETAILED DESCRIPTION

Figure 1:
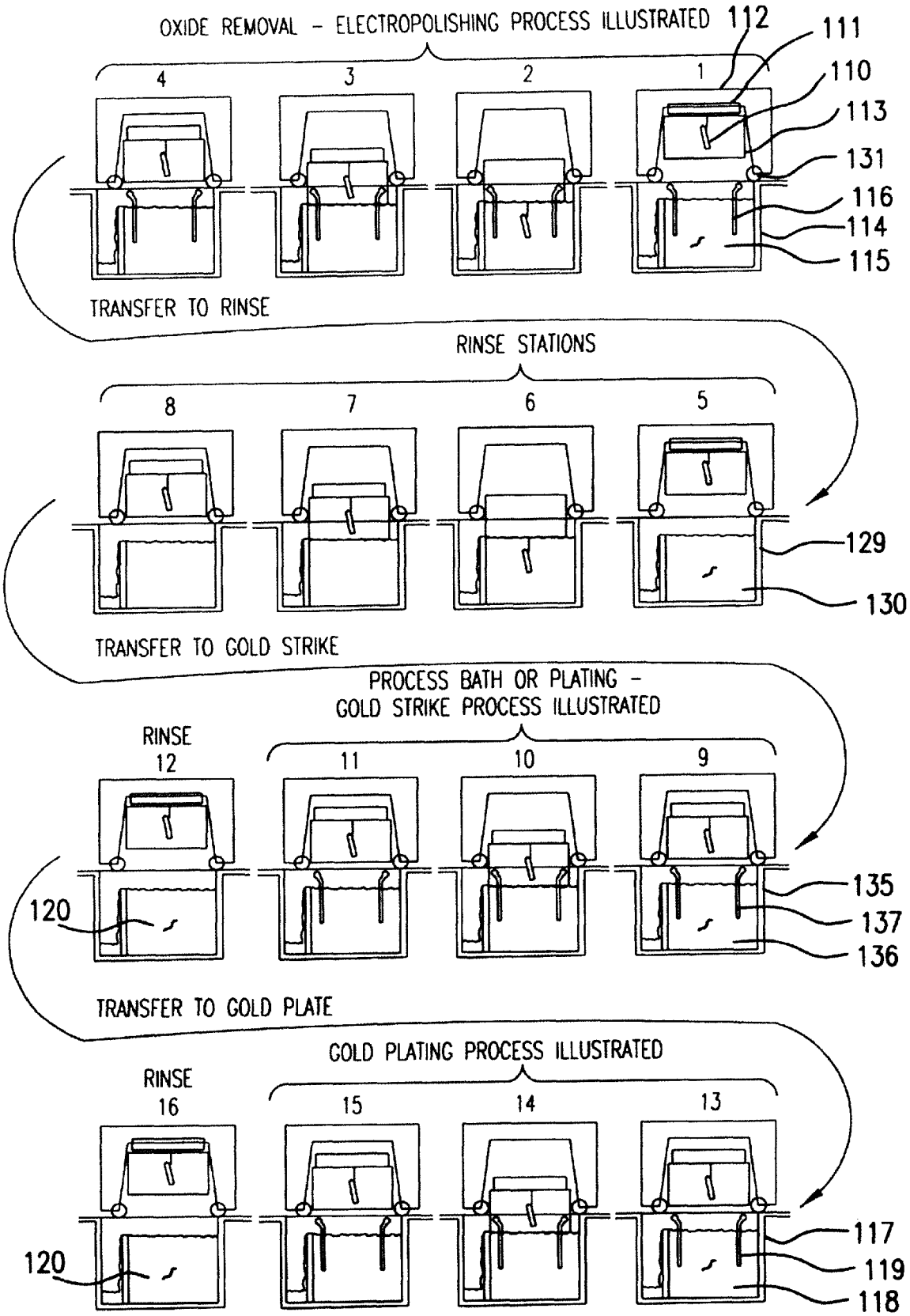
FIG. 1 illustrates a process for coating a nitinol stent with a radiopaque gold coating, in accordance with an embodiment of the present invention.

The present invention provides for methods of coating metallic articles that result in the improved adhesion and integrity of the coating. Specifically, the inventors have found that by removing contaminants such as oxides from the surface of a metallic article prior to coating it, and further, by maintaining a substantially oxide-free surface on the article at all times prior to the coating process, an improved coating results. Therefore, in an exemplary embodiment, the present invention relates to a method comprising the steps of providing a metallic article having an external surface with an oxide thereon; removing at least part of the oxide from the article; and placing a coating on the article.

The present invention is described with specific reference to an embodiment in which the metallic article to be coated is a nitinol stent, which is coated with a radiopaque gold layer by electroplating. However, the scope of the invention includes any coating process and coating material that would benefit from the removal of oxide and other contaminants from the article surface prior to the coating process. Such coating processes include, for example, vacuum coating, sputtering, ion plating, chemical vapor deposition, hot dip coating, electroplating, electroless plating, and the like. Coating materials within the scope of the invention include any materials that render desired surface properties to the article to be coated. For example, materials such as gold, platinum, silver and tantalum are used as coating materials in embodiments of the present invention to provide enhanced radiopacity to medical devices.

In addition, the present invention is applicable to substrate materials other than nitinol that readily form an oxide upon exposure to an oxygen-containing atmosphere or from which contaminants such as oxides are advantageously removed prior to coating. It is particularly useful, however, to use nitinol in conjunction with the methods of present invention because heavy oxides often form on the nitinol surface as a result of thermal processing techniques that are used to render shape memory properties or other desired properties to a nitinol article.

FIG. 1 shows an embodiment of the present invention in which a nitinol stent is subjected to an oxide removal process followed by a gold electroplating process. In FIG. 1, Stations 1 to 4 illustrate an oxide removal process, Stations 5 to 8 illustrate a rinse process, Stations 9 to 12 illustrate a gold strike process, and Stations 13 to 16 illustrate a gold electroplating process. In accordance with this embodiment, a nitinol stent 110 is removably mounted to a processing fixture 111 within a transfer carriage 112. The processing fixture 111 is moveable within a shield enclosure 113 of the transfer carriage 112. To begin an oxide removal process, the transfer carriage 112 is positioned over an oxide removal tank 114, which houses an electropolishing bath 115 and electrodes 116 as shown in Station 1 of FIG. 1. The processing fixture 111 lowers the stent 110 and the shield enclosure 113 into the oxide removal tank 114, as shown in Station 2 of FIG. 1. The shield enclosure 113, however, is lowered only until it is just above the level of electropolishing bath 115. A current is then applied to the electropolishing bath 115 such that the stent 110, which is submerged in the electropolishing bath 115, is electropolished and any oxide on the surface of the stent 110 is thereby removed. Alternatively, the oxide removal tank houses a chemical etching bath for removing oxides in the absence of an electric current.

A preferred electropolishing procedure for oxide removal involves electropolishing in a cold sulfuric acid and methanol electrolyte. The cold electropolishing bath 115, which is held at temperatures, for example, less than about 0° C., about −25° C., or about −55° C., is believed to be a novel aspect of the invention. In a preferred embodiment, the temperature of the electropolishing bath 115 is maintained within the temperature range of about −45° C. to about −65° C. throughout the electropolishing process.

A preferred chemical etch procedure for oxide removal involves etching in a mixture of hydrofluoric and nitric acids to effectively remove titanium oxides from the stent surface. Such acid mixtures typically range from about 15% to about 35% hydrofluoric acid, balance nitric acid. Residence times in the acid etch vary from about 30 seconds to about 2 minutes.

When the electropolishing or chemical etching process is complete, the processing fixture 111 and the stent 110 are raised into the shield enclosure 113 as shown in Stations 3 to 4 of FIG. 1. A source of inert gas (not shown) is coupled to the transfer carriage 112 such that the inert gas is capable of flowing into the transfer carriage 112 and the shield enclosure 113. As the stent 110 is raised, the inert gas is injected through an input located in the transfer carriage 113 and into the shield enclosure 113, thus substantially surrounding the stent 110. The inert gas used in the present invention is any suitable gas so long as the stent 110 remains substantially oxide-free when exposed thereto. Preferred inert gases for use in the present invention include nitrogen, argon and mixtures thereof.

Following oxide removal, the stent 110 is preferably subject to a rinse process by dipping into a rinsing tank 129, as illustrated in FIG. 1, Stations 5 to 8. The rinsing tank 129 houses a rinsing bath 130 of any suitable rinse media, such as deionized water. The stent is moved from the oxide removal tank 114 to the rinsing tank 129 and all subsequent tanks by the movement of the transfer carriage 112 over these tanks by any suitable means. For example, the transfer carriage 112 optionally includes rollers 131 for movement over successive tanks, preferably along alignment tracks. As shown in FIG. 1, the stent 110 is kept within an inert gas environment throughout the rinse process.

Following the rinse process and while the stent 110 remains subjected to the inert gas, the transfer carriage 112 is positioned over an electroplating tank 117, which houses an electroplating bath 118 and electrodes 119 as shown in Station 13 of FIG. 1. The processing fixture 111 lowers the stent 110 and the shield enclosure 113 into the electroplating tank 117. The shield enclosure 113 is lowered until it is just above the level of the electroplating bath 118, as shown in Station 14 of FIG. 1. The stent 110, however, is lowered into the electroplating bath 118, and a current is passed through the electroplating bath 118 until the stent 110 is coated to a desired thickness. At all times between when the stent 110 is raised from the electropolishing bath 115 until it is lowered into the electroplating bath 118, it is subjected to an inert gas environment such that the stent surface remains substantially oxide-free.

The electroplating bath 118 is any suitable bath such as, for example, gold bath ACR 434, available from Technic Incorporated. The plating process is preferably performed at low current densities such as, for example, 2 to 5 amps per square foot, to promote a low stress, fine grain and bright deposit. At 2 amps per square foot, the plating time is about one hour to obtain a 300 microinch deposit. After electroplating, the stent 110 is preferably rinsed in hot deionized water, and dried.

Although the present invention is not limited to gold coated devices, gold is the most preferred candidate for coating medical devices to increase radiopacity, given its biocompatibility and ease of deposition, the control of properties using electroplating methods, the availability of high purity electroplating solutions and the good recovery costs for scrap and spent solutions.

Although not shown in FIG. 1, the stent 110 is optionally cleaned in a detergent solution using ultrasonic techniques to remove any surface containments prior to coating. Solvent degreasing is optionally used where heavy oils are present. After such degreasing techniques, the nitinol stent is preferably double rinsed in deionized water to remove any cleaning agents remaining on the surface thereof.

Another embodiment of the present invention includes a strike process after the oxide removal process and prior to the coating process, as shown in Stations 9 to 12 of FIG. 1. The strike process is an electroplating process, but involves different processing parameters (for example, bath composition, current density, and/or plating time, etc.) compared to those used to plate the final coating of the present invention. The strike process is accomplished using a strike tank 135, which houses a strike bath 136, and electrodes 137. The purpose of the strike is to deposit a thin layer of material such as gold onto the substantially oxide-free nitinol stent 110, thus preserving the surface of the stent 110 for subsequent final coating.

The strike process is preferably accomplished in a low pH, such as pH<1, environment using a high current density, such as about 80 to about 110 amps per square foot. The strike layer is preferably applied to a thickness of about 1 to about 30 microinches. By way of example, the strike bath is an acid gold strike bath from Technic Incorporated. It is preferred that the strike bath comprise a fluorine-containing chemical to remove any remaining oxides that exists on the surface of the stent 110. For example, in a preferred embodiment, about 5%. by volume or about 5% by weight of hydrofluoric acid or ammonium bifluoride is added to the strike bath. The stent is optionally submerged in the strike bath with hydrofluoric acid for about 15 to about 45 seconds prior to the application of an electric current so that the hydrofluoric acid removes any oxide from the stent surface and thus presents a native metal surface to the strike process. Alternatively, the stent is submerged in the strike bath with the current applied. Owing to the strike layer applied in this embodiment, the surface of the article is protected from further oxidation. As such, the time between the strike plating and the electroplating is not critical.

In another embodiment of the invention, the inert gas shown in FIG. 1 is not used. Instead, the article to be coated is rinsed in deionized water after the oxide removal process for a few seconds and then immediately transferred to either a strike bath or an electroplating bath. The rinse time and transfer time to the strike bath or electroplating bath are preferably kept within a few seconds to avoid the recurrence of an oxide layer. Rinsing is performed, for example, with use of a spray rinser or in a rinse tank with ultrasonic or mechanical agitation techniques. Alternatively, rinsing is performed while an electric current is applied to the article to be coated as a cathode, wherein low current is preferably applied for a time period up to about 30 seconds. The cathodic water cleaning process provides a reducing atmosphere around the article and prevents oxide formation during the rinse. Where a strike layer is applied in this embodiment, the surface of the article is protected from further oxidation. As such, the time between the strike plating and the electroplating is not critical.

Although the invention is described with specific reference to FIG. 1 and the processes therein, the scope of the invention includes any suitable oxide removal process and coating process. For example, in an embodiment of the present invention, plasma etching is used for the oxide removal process and an ion beam assisted deposition process is used for the coating process. By making use of the plasma etching process and the ion beam assisted deposition process, the use of all potentially hazardous chemicals is eliminated.

When used with an embodiment of the present invention, the plasma etching process results in the removal of oxide from an article to be coated. In the plasma etching apparatus, which consist of a vacuum chamber containing anode and a cathode, the articles positioned between the anode and cathode and vacuum is applied and then backfilled with a flow of reactive gas. The reactive gas is energized, thus forming a glow discharge gas plasma between the anode and cathode and thus surrounding the article. The gas plasma reacts with any oxide on the surface of the article, causing it to be etched away and drawn off under the vacuum.

When used with an embodiment of the present invention, the ion beam assisted deposition process deposits any suitable coating on a substantially oxide-free article. As is known in the art, an ion beam assisted deposition apparatus consists of a vacuum chamber containing an ion beam generator/accelerator, a metallic target vaporizer and a fixture/motion system. The article is loaded into the chamber/motion system after the chamber is closed, the vacuum is applied and the chamber is backfilled with an inert gas. The ion beam generator, which is aimed at the article, is then energized to cause the surface of the article to be bombarded with ions of the inert gas, thus cleaning the article surface of any newly formed oxide as the article moves in its motion system to expose all surfaces of the article. While still under vacuum, the target vaporizer and ion beam generator are energized to cause vapor of the material to be deposited to form in the path of the accelerated ion beam and thus depositing onto all surfaces of the article. This process is continued until the coating is built up to a desired thickness on the article, thus creating the finished coated article.

Although the present invention is described with specific reference to stents, the scope of the invention includes any article to which a coating is advantageously applied. For example, implantable medical devices such as blood filters, hemostatic clips, prostheses, guide wires and the like are within the scope of the present invention. Specific examples of stents that may be used in connection with the present invention include the NIR (Medinol, Tel Aviv, Israel), the RADIUS (SCIMED Life Systems, Inc., Minneapolis, Minn.), the SYMPHONY (Boston Scientific Corp., Natick, Mass.), and the DIAMOND biliary stents (Boston Scientific Corp., Natick, Mass.).

The invention is further described with reference to the following non-limiting example.

EXAMPLE

A nitinol DIAMOND biliary stent (Boston Scientific Corp., Natick, Mass.) was electroplated with a radiopaque gold according to the following processing parameters.

The stent was cleaned by submersion in an ultrasonic bath containing an aqueous solution of about 20% by volume of ALTERNATIVE 2000® detergent available from U.S. Polychemical Corp. 584 Chestnut Ridge Road, Chestnut Ridge, N.Y. 10977 and characterized by a 40 KHz ultrasonic agitation, for about 10 minutes at room temperature. The stent was then rinsed in deionized water with moderate agitation for about 30 seconds at room temperature, and cleaned in deionized water in an ultrasonic bath for about 10 minutes at room temperature.

The stent was electropolished to remove surface oxides on the surface thereof. The electropolishing bath contained about 15 to about 25% by volume of reagent grade sulfuric acid, balance methanol. Electropolishing was conducted at a temperature of about −30 to about −90° C., with moderate to vigorous agitation, an applied voltage of about 20 to about 40 volts, and an immersion time of about 1 to about 4 minutes. The stent may be substantially surrounded by a nitrogen environment immediately following electropolishing.

Following the electropolishing process, the stent was rinsed in deionized water at room temperature for about 15 seconds, and may be returned to a nitrogen environment.

The stent was then subjected to a strike process by submerging in a strike bath containing gold (III) cyanide, sodium chloride, and hydrofluoric acid, and applying a current of about 1 to about 10 amps per square foot for a time period of about 30 seconds to about 3 minutes under moderate agitation. Following the strike process, the stent was rinsed in deionized water. The strike process resulted in an adherent, continuous gold layer having a thickness of about 5 microinches. Visual inspection confirmed that the strike layer was adherent and uniform.

Prior to electroplating a radiopaque gold coating, the stent was cleaned by submersion in an ultrasonic bath containing an aqueous solution of about 20% by volume of ALTER- NATIVE 2000® detergent, and characterized by a 72 KHz ultrasonic agitation, for about 2 minutes at room temperature. The stent was then rinsed in deionized water. The stent was then coated by electroplating in an ACR 434 gold bath at about 65° C. using an applied current of about 2 amps per square foot, for about 60 minutes under moderate agitation. The coated stent was then rinsed in deionized water for about one minute at room temperature, and then for about 3 minutes at about 82° C. The result of the electroplating process is an adherent, continuous gold coating having a thickness of about 300 microinches.

It is to be understood that the thicknesses of the strike and electroplating layers can be varied by suitable variations in processing parameters.

The present invention provides for metallic articles having coatings of enhanced adhesion and integrity. Those with skill in the art may recognize various modifications to the embodiments of the invention described and illustrated herein. Such modifications are meant to be covered by the spirit and scope of the appended claims.

We claim:

1. A method of coating a nitinol medical device comprising the steps of:

providing said device having an external surface with an oxide thereon;

removing at least part of said oxide from said external surface of said device;

exposing said device exclusively to environments substantially free from oxygen as of the step of removing at least part of said oxide to the step of electroplating a gold strike layer, said oxygen free environments comprising an inert gas;

electroplating a gold strike layer onto said device, wherein said electroplating comprises the steps of:

preparing a strike bath comprising a fluorine-containing chemical;

placing said device into said strike bath; and applying a current to said strike bath such that said strike layer is applied to said device; and electroplating a second gold coating on said device.

2. The method of claim 1, wherein said inert gas is selected from the group consisting of nitrogen, argon, and mixtures thereof.

3. The method of claim 1, wherein said step of removing at least part of said oxide comprises the step of electropolishing said nitinol medical device.

4. The method of claim 3, wherein said electropolishing is conducted in an electrolyte comprising sulfuric acid and methanol.

5. The method of claim 4, wherein said electrolyte is maintained within a temperature range of from about −45° C. to about −65° C. during said electropolishing.

6. The method of claim 1, wherein said fluorine-containing chemical is selected from the group consisting of hydrofluoric acid and ammonium bifluoride.

7. The method of claim 1, wherein said medical device is selected from the group consisting of stents, filters, clips, prostheses and guide wires.

* * * * *